US010815844B2

(12) United States Patent
Camilo et al.

(10) Patent No.: US 10,815,844 B2
(45) Date of Patent: Oct. 27, 2020

(54) CAMSHAFT PHASER WITH PIN

(71) Applicant: SCHAEFFLER TECHNOLOGIES AG & CO. KG, Herzogenaurach (DE)

(72) Inventors: Alexandre Camilo, Rochester Hills, MI (US); Gilson Arima, Rochester Hills, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/364,800

(22) Filed: Mar. 26, 2019

(65) Prior Publication Data

US 2020/0308995 A1 Oct. 1, 2020

(51) Int. Cl.
*F01L 1/344* (2006.01)

(52) U.S. Cl.
CPC ... *F01L 1/3442* (2013.01); *F01L 2001/34456* (2013.01); *F01L 2001/34469* (2013.01)

(58) Field of Classification Search
CPC ... F01L 2001/34456; F01L 2001/34469; F01L 2001/34459; F01L 2103/00; F01L 2303/00; F01L 2303/01
USPC ..... 123/90.15, 90.16, 90.17
See application file for complete search history.

(56) References Cited

U.S. PATENT DOCUMENTS 6,609,498 B2 8/2003 Mathews et al.
7,305,949 B2 * 12/2007 McCarthy ..... F01L 1/34 123/195 C
2007/0277758 A1 * 12/2007 Fischer ..... F01L 1/3442 123/90.17
2009/0017920 A1 * 1/2009 Fox ..... F01L 1/3442 464/1
2009/0198437 A1 * 8/2009 Mladenovic ..... F01L 1/34 701/105
2010/0186700 A1 * 7/2010 Kandolf ..... F01L 1/3442 123/90.17
2012/0031358 A1 * 2/2012 Knecht ..... F01L 1/3442 123/90.15
2013/0180497 A1 * 7/2013 Saiki ..... F02B 75/00 123/197.1
2014/0190434 A1 * 7/2014 Bayrakdar ..... F01L 1/3442 123/90.17
2018/0058274 A1 * 3/2018 Lichti ..... F01L 1/3442
2019/0170028 A1 * 6/2019 Kandolf ..... F01L 1/3442
2019/0170165 A1 * 6/2019 Chung ..... F15B 15/20

* cited by examiner

*Primary Examiner* — Devon C Kramer
*Assistant Examiner* — Kelsey L Stanek
(74) *Attorney, Agent, or Firm* — Brooks Kushman P.C.

(57) ABSTRACT

A camshaft phaser includes a stator defining a cavity and configured to receive power from an engine crankshaft. The phaser further includes a rotor supported within the cavity and rotatable relative to the stator. The rotor has a first face, a second face, and a first hole extending from the first face to the second face. A target wheel of the phaser has a plate portion configured to be read by a camshaft-position sensor and a hub portion seated on the first face. The hub portion defines a second hole that is aligned with the first hole. A pin extends through the first and second holes to rotationally align and secure the target wheel to the rotor.

19 Claims, 3 Drawing Sheets

CAMSHAFT PHASER WITH PIN

TECHNICAL FIELD

The present disclosure relates to camshafts for internal combustion engines and more particularly to camshaft phasers that modify operation of camshafts.

BACKGROUND

Internal combustion engines include a plurality of cylinders having pistons disposed therein. The pistons are connected to a crankshaft that outputs power produced by the engine. The cylinders have associated intake and exhaust valves that introduce a fuel-air mixture into the cylinders and expel combusted gases, respectively. The valves are controlled by one or more camshafts. The camshafts are driven by the crankshaft and synchronized to the crankshaft so that the valves open and close at the appropriate times. Traditionally, the timing of the camshaft relative to the crankshaft was fixed. Many modern engines, however, include variable valve timing (VVT) to improve performance and/or fuel economy. Engines equipped with VVT may include one or more camshaft phasers (also known as variators) that adjust the position of associated camshafts relative to the crankshaft to vary valve timing.

SUMMARY

According to one embodiment, a camshaft phaser includes a stator defining a cavity and configured to receive power from an engine crankshaft. The phaser further includes a rotor supported within the cavity and rotatable relative to the stator. The rotor has a first face, a second face, and a first hole extending from the first face to the second face. A target wheel of the phaser has a plate portion configured to be read by a camshaft-position sensor and a hub portion seated on the first face. The hub portion defines a second hole that is aligned with the first hole. A pin extends through the first and second holes to rotationally align and secure the target wheel to the rotor.

According to another embodiment, a camshaft phaser includes a rotor defining a first axial hole configured to align with a second axial hole of a camshaft when the rotor and camshaft are attached. A target wheel defines a third axial hole and is seated against the rotor with the first and third holes aligned. A pin is extendable through the first, second, and third holes to rotationally align the target wheel, the rotor, and the camshaft to each other and secure the target wheel to the rotor.

According to yet another embodiment, a camshaft phaser includes a stator, a rotor supported within the stator to be selectively rotatable relative to the stator, and a target wheel adjacent the rotor. The rotor and the target wheel define first and second axial holes, respectively, that are aligned with each other. The camshaft phaser further includes a pin extending through the first and second holes to rotationally align and secure the target wheel to the rotor.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
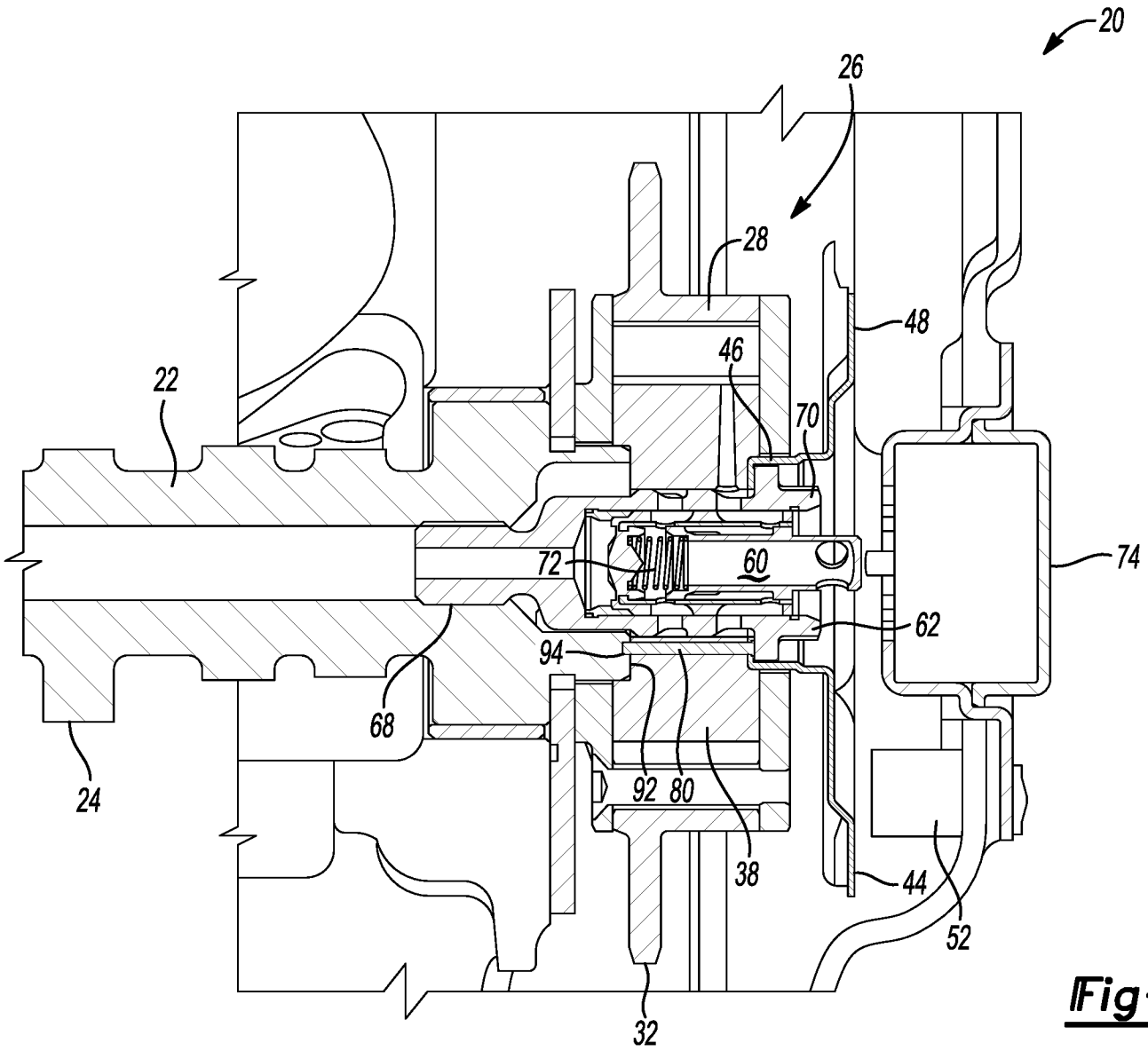
FIG. 1 is a partial cross-sectional view of an engine having variable valve timing.

Referring to FIG. 1, an internal combustion engine 20 includes a block and heads. The heads may include an overhead cam (OHC) configuration in which one camshaft (SOHC) or two camshafts (DOHC) are supported for rotation above the valves. Each camshaft 22 includes lobes 24 arranged to engage with valves through one or more intermediary components, such as rocker arms. The lobes 24 are shaped to open and close the intake and exhaust valves at the appropriate times. The camshaft 22 is driven by a crankshaft through a 1:2 reduction, i.e., two rotations of the crankshaft equal one rotation of the camshaft.

The engine 20 includes variable valve timing (VVT) in which the angular position (known as phase or phase angle) of the camshaft 22 is modified relative to the crankshaft to advance and/or retard timing of the engine 20. The timing may be modified to increase engine performance, e.g. increase power, and/or improve fuel economy. The engine 20 may include one or more camshaft phasers configured to change the phase of one or more camshafts. Each camshaft phaser may be associated with one or more camshafts. In the illustrated embodiment, a camshaft phaser 26 is associated with the camshaft 22.

Figure 2:
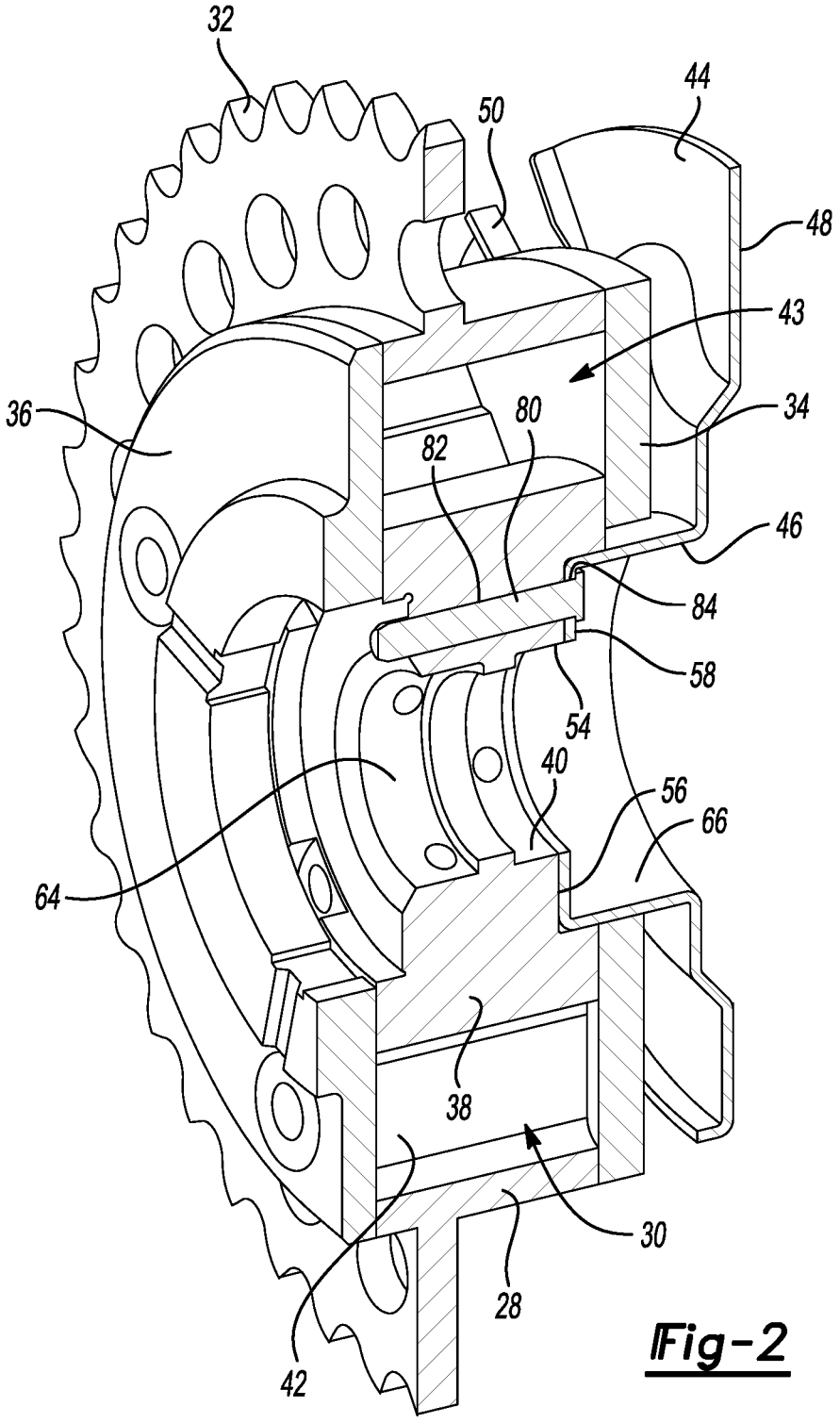
FIG. 2 is a cross-sectional perspective view of a camshaft phaser.

Referring to FIGS. 1 and 2, the camshaft phaser 26 may include an annular stator 28 defining a cavity 30. The stator 28 may include an outer circumferential wall and a pair of cover plates 34 and 36 that cooperate to define the cavity 30. The stator 28 is driveably connected to the crankshaft by a tension member (typically a timing chain or timing belt) to be fixed rotationally relative to the crankshaft. In the illustrated embodiment, the stator 28 includes a sprocket 32 connected to the crankshaft with a timing chain. Of course, the sprocket 32 may be swapped with a pulley and the chain with a timing belt.

A rotor 38 is supported within the cavity 30 and is rotatable relative to the stator 28. The rotor 38 includes a hub 40 connectable to the camshaft 22 and rotationally fixed relative to the camshaft 22. The camshaft phaser 26 changes phase angle by rotating the rotor 38 relative to the stator 28. This changes the phase of the camshaft 22 relative to the crankshaft. The camshaft phaser may be configured to rotate the rotor 38 forward relative to the stator 28 to advance timing and/or rotate the rotor 38 backwards relative to the stator to retard timing. The rotor 38 may be hydraulically operated. For example, the rotor 38 may define a plurality of projections 42 that cooperate with the stator to define a plurality of chambers 43. The rotor 38 may define a plurality of fluid passageways in fluid communication with the chambers 43. The rotational position of the rotor 38 relative to the stator 28 can be modified by supplying and removing fluid from the chambers 43.

The camshaft phaser 26 includes a target wheel 44 connected to the rotor 38 and configured to be read by a camshaft-position sensor 52 to determine the angular position of the camshaft 22. The camshaft sensor 52 may be a hall-effect sensor or the like. The target wheel 44 may include a huh portion 46 and a plate portion 48. The hub portion 46 may have a first radial surface 56 disposed against a first radial face 54 of the rotor 38. The plate portion 48 is generally circular with a plurality of features 50, such as teeth, notches, slots, gaps, etc., that are readable by the camshaft-position sensor 52. The target wheel 44 is angularly indexed to the rotor 38 (and likewise to the camshaft) so that the position sensor 52 can detect a rotational position of the rotor 38 and camshaft 22 to enable proper phasing of the camshaft 22.

The camshaft phaser 26 may be attached to the camshaft 22 by a valve bolt 60. The valve bolt 60 includes a fastener 62 extending through central holes 64, 66 in the rotor 38 and the target wheel 44 and threadedly engages with a threaded bore 68 of the camshaft 22. The fastener 62 includes a head 70 that engages with a second radial surface 58 of the hub portion 46. The fastener 62 robustly secures the target wheel 44 to the rotor 38 and robustly secures the rotor 38 to the camshaft 22 so that these components rotate together. The valve bolt 60 may also include a valve 72 disposed within a central opening of the fastener 62. The valve 72 controls fluid supply to the cavity 30 to operate the camshaft phaser 26. A solenoid 74 associated with the valve bolt 60 is configured to operate the valve 72.

The angular position of the target wheel 44 relative to the rotor 38 and the angular position of the camshaft 22 relative to the rotor 38 is important for proper operation of the engine 20. If any of these components become angularly misaligned, the camshaft-position sensor 52 will inaccurately report the position of the camshaft 22 resulting in improper functioning of the engine 20. For example, the engine 20 will not operate correctly if the angular position of the target wheel 44 relative to the rotor 38 becomes misaligned during shipping, handling, or assembly of the camshaft phaser 26.

The valve bolt 60 is a main component for robustly securing the target wheel 44 to the rotor 38. The valve bolt 60, however, is not installed until the camshaft phaser 26 is attached to the engine 20. That is, the valve bolt 60 is not present during shipping and handling of the camshaft phaser 26. This introduces the possibility of the target wheel 44 rotating relative to the rotor 38. To solve these and other problems, the camshaft phaser 26 includes a pin installed during assembly of the camshaft phaser 26 and configured to maintain correct rotational positioning between the target wheel 44 and the rotor 38 during subsequent handling and shipping. The pin is also configured to aid in rotational alignment of the camshaft phaser 26 to the camshaft 22.

Figure 3:
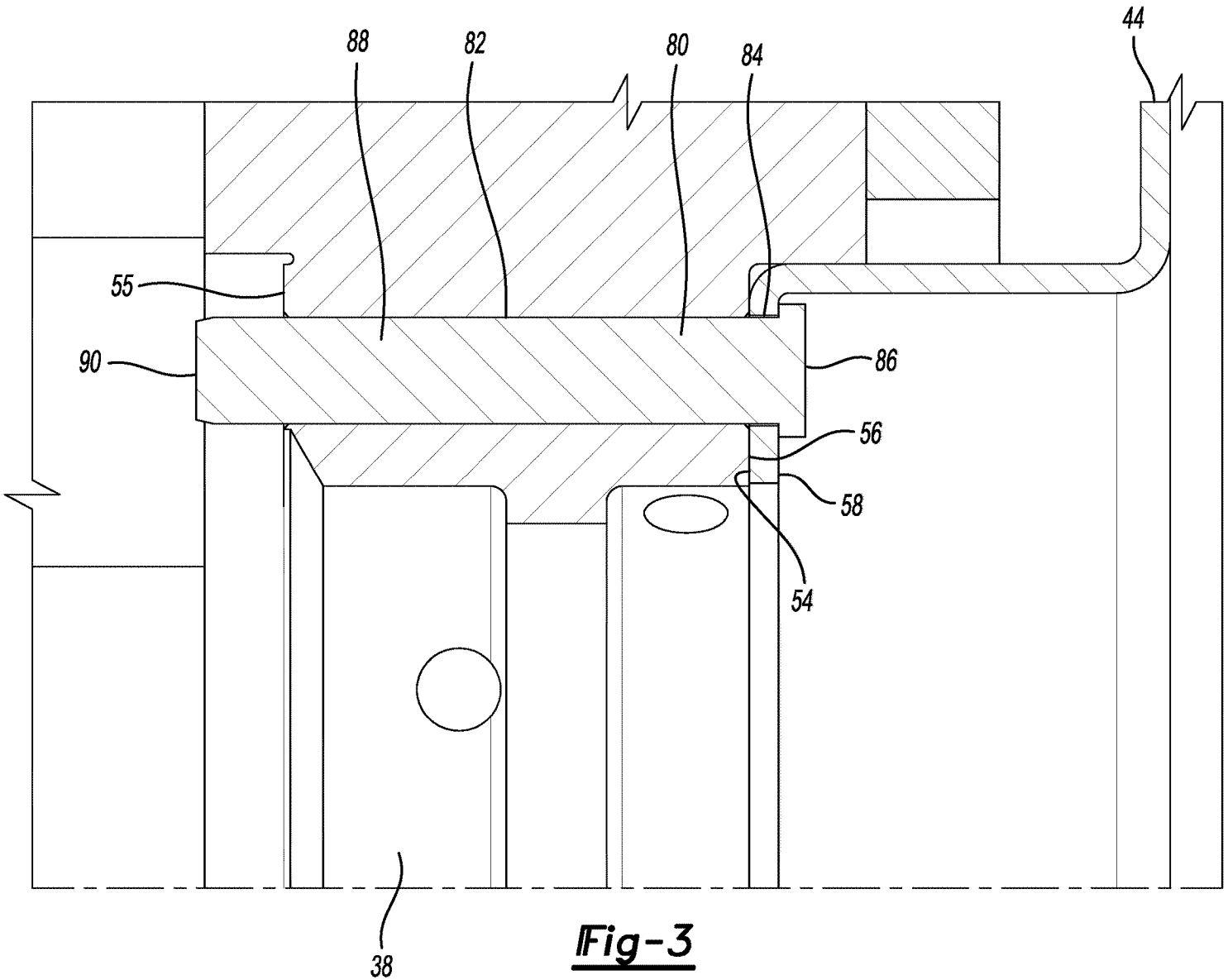
FIG. 3 is a magnified view of the camshaft phaser of FIG. 2 detailing the pin and surrounding area.

Referring to FIGS. 2 and 3, a pin 80 extends through holes 82 and 84 defined by the hub 40 of the rotor 38 and the hub portion 46 of the target wheel 44 to retain the target wheel 44 to the rotor 38. The hub portion 46 may have a radial wall that defines the hole 84. The holes 82 and 84 are placed at specific angular locations so that the target wheel 44 is in the proper angular position relative to the rotor 38 when the pin 80 is installed. In this way, the pin 80 acts as both a connection feature and an alignment feature. The hole 82 extends from the first face 54 to a second face 55 of the hub 40 so that the hole 82 extends axially completely through the rotor 38. The hole 84 extends axially from the first radial surface 56 to the second radial surface 58 to extend completely through the target wheel 44. The pin 80 includes a head 86 and a shank 88 having a distal end 90. The head 86 is larger than the hole 84 and disposed against the second radial surface 58. The shank 88 has an unbiased diameter ($D_1$) that is smaller than a diameter ($D_2$) of the hole 84 so that the shank 88 passes freely therethrough. The diameter ($D_3$) of the hole 82 is smaller than $D_1$ of the shank 88 creating an interference fit (press fit) between the shank 88 and the rotor 38 when the pin 80 is installed. The interference fit retains the pin 80 in place. The shank 88 is longer than the axial thickness of the target wheel 44 and the rotor 38 so that the distal end 90 projects past the second face 55 creating an alignment feature for attaching the camshaft phaser 26 to the camshaft 22. The shank 88 has a smooth outer surface, e.g., no threads or ridges, to facilitate press fitting of the pin 80.

Referring to FIG. 1, the camshaft phaser 26 is installed onto the head of the engine 20 by aligning the distal end 90 of the pin 80 with a hole 94 defined in the camshaft 22 and inserting the pin 80 into the hole 94 until an end face 92 of the camshaft 22 is adjacent to the second radial face 55 of the rotor 38. The hole 94 may extend axially from the end face 92 into an interior of the camshaft 22. The hole 94 is angularly positioned so that the target wheel 44 and the rotor 38 are in the correct angular position relative to the camshaft 22. The pin 80 and the hole 94 cooperate as a key to prevent misaligned connection of the camshaft 22 to the camshaft phaser 26. A diameter of the hole 94 may be larger than the diameter of the shank 88 allowing the pin 80 to be received easily into the camshaft 22. The valve bolt 60 is installed through the camshaft phaser 26 and into the camshaft 22 to robustly secure the camshaft phaser 26 to the engine 20. The head 86 of the pin 80 may be recessed into the hub portion 46 to not interfere with the head 70 of the fastener 62.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

The following is a list of reference numbers shown in the Figures. However, it should be understood that the use of these terms is for illustrative purposes only with respect to one embodiment. And, use of reference numbers correlating a certain term that is both illustrated in the Figures and present in the claims is not intended to limit the claims to only cover the illustrated embodiment.

PARTS LIST

20 engine
22 camshaft
24 lobes
26 camshaft phaser
28 stator
30 cavity
32 sprocket
34 cover plate
36 cover plate
38 rotor
40 hub
42 projections
43 chambers
44 target wheel
46 hub portion
48 plate portion
50 features
52 camshaft-position sensor
54 first radial face
55 second radial face
56 first radial surface
58 second radial surface
60 valve bolt
62 fastener
64 hole
66 hole
68 bore
70 head
72 valve
74 solenoid
80 pin
82 hole
84 hole
86 head
88 shank
90 distal end
92 end face
94 hole

What is claimed is:

1. A camshaft phaser comprising:

a stator defining a cavity and configured to receive power from an engine crankshaft;

a rotor supported within the cavity and rotatable relative to the stator, the rotor including a first face, a second face, and a first hole extending from the first face to the second face, wherein the first hole is radially offset from a central axis of the rotor;

a target wheel including a plate portion configured to be read by a camshaft-position sensor and a hub portion seated on the first face, the hub portion defining a second hole that is aligned with the first hole; and a pin radially offset from the central axis and extending through the first and second holes to rotationally align and secure the target wheel to the rotor.

2. The camshaft phaser of claim 1, wherein the pin defines a head engaging with the hub portion.

3. The camshaft phaser of claim 1, wherein pin has an unbiased diameter larger than a diameter of the first hole so that the pin is interference fit to the rotor.

4. The camshaft phaser of claim 1, wherein the rotor further includes a bore centered on the central axis and extending from the first face to the second face.

5. The camshaft phaser of claim 4, further comprising a fastener extendable through the bore.

6. The camshaft phaser of claim 1, wherein the first face extends radially, and the hub portion has a radial wall seated on the first face and defining the second hole.

7. The camshaft phaser of claim 1, wherein the pin extends past the second face.

8. The camshaft phaser of claim 1, wherein the stator and the rotor cooperate to define fluid chambers configured to rotate the rotor relative to the stator according to fluid therein.

9. The camshaft phaser of claim 1, wherein the plate portion defines features configured to be read by the camshaft-position sensor.

10. A camshaft phaser comprising:

a rotor defining a first axial hole configured to align with a second axial hole of a camshaft when the rotor and camshaft are attached;

a target wheel defining a third axial hole and seated against the rotor with the first and third holes aligned and a pin extendable through the first, second, and third holes to rotationally align the target wheel, the rotor, and the camshaft to each other at a predefined angular position and secure the target wheel to the rotor, wherein a central axis of the pin is radially outboard of a central axis of the rotor.

11. The camshaft phaser of claim 10, wherein a diameter of the first axial hole is smaller than an unbiased diameter of the pin creating an interference fit between the pin and the rotor.

12. The camshaft phaser of claim 10, wherein the pin defines a head engaging with the target wheel.

13. The camshaft phaser of claim 10, wherein the pin has a head disposed against the target wheel and a shank extendable through the first, second, and third holes, and further comprising a fastener including a shank extendable through the rotor and configured to secure the camshaft phaser to the camshaft.

14. The camshaft phaser of claim 10, wherein the camshaft phaser further includes a stator configured to receive power from an engine crankshaft, wherein the stator defines a cavity that receives the rotor therein.

15. The camshaft phaser of claim 10, wherein the target wheel defines features including one or more of teeth, notches, slots, or gaps, and further comprising a camshaft-position sensor configured to read the features.

16. A camshaft phaser comprising:

a rotor defining a first axial hole radially offset from a central axis of the rotor, the first axial hole being configured to align with a second axial hole of a camshaft when the rotor and the camshaft are attached;

a target wheel defining a third axial hole radially offset from the central axis of the rotor, wherein the target wheel is seated against the rotor with the first and third holes aligned; and a pin radially offset from the central axis and extendable through the first, second, and third holes to rotationally align the target wheel, the rotor, and the camshaft to each other and secure the target wheel to the rotor.

17. The camshaft phaser of claim 16, wherein the rotor includes a hub defining a first hollow central bore, and the target wheel defines a second hollow central bore, and wherein the first axial hole and the third axial hole are disposed radially outboard of the first and second central bores, and the first and second central bores are aligned when the target wheel is seated against the rotor.

18. The camshaft phaser of claim 17 further comprising a fastener extendable through the first and second central bores and configured to secure the rotor and the target wheel to the camshaft.

19. The camshaft phaser of claim 16, wherein the pin has an unbiased diameter that is larger than a diameter of the first axial hole to create an interference fit that retains the pin to the rotor.

* * * * *